United States Patent [19]

Fromm et al.

[11] Patent Number: 4,633,136

[45] Date of Patent: Dec. 30, 1986

[54] HIGH-PRESSURE DISCHARGE LAMP WITH LOW POWER INPUT

[75] Inventors: Dietrich Fromm, Warngau; Helmut Klingshirn, Munich; Achim Gosslar, Munich; Jurgen Heider, Munich, all of Fed. Rep. of Germany

[73] Assignee: Patent-Treuhand-Gesellschaft fur elektrische Glühlampen mbH, Munich, Fed. Rep. of Germany

[21] Appl. No.: 484,568

[22] Filed: Apr. 13, 1983

[30] Foreign Application Priority Data

Apr. 20, 1982 [DE] Fed. Rep. of Germany ..... 3214642

[51] Int. Cl.[4] ..... H01J 61/06; H01J 61/36

[52] U.S. Cl. ..... 313/623; 313/631

[58] Field of Search ..... 313/631, 571, 572, 641, 313/638, 639, 640, 642, 634, 632, 628, 623

[56] References Cited

U.S. PATENT DOCUMENTS

| | | | |
|---|---|---|---|
| 3,349,276 | 10/1967 | Jacobs et al. | 313/628 |
| 3,484,637 | 12/1969 | Van Boort et al. | 313/571 X |
| 3,947,714 | 3/1976 | Rehder et al. | 313/638 |
| 4,101,796 | 7/1978 | Kuus . | |
| 4,232,243 | 11/1980 | Rigden | 313/642 X |
| 4,275,329 | 6/1981 | Fridrich et al. | 313/628 |
| 4,387,319 | 6/1983 | White et al. | 313/634 X |
| 4,415,829 | 11/1983 | Rothwell, Jr. et al. | 313/632 X |

FOREIGN PATENT DOCUMENTS

| | | | |
|---|---|---|---|
| 577060 | 6/1959 | Canada | 313/571 |
| 1005809 | 9/1965 | United Kingdom | 313/641 |
| 1242173 | 8/1971 | United Kingdom . | |
| 2043331 | 10/1980 | United Kingdom . | |

*Primary Examiner*—Palmer C. DeMeo

*Attorney, Agent, or Firm*—Frishauf, Holtz, Goodman & Woodward

[57] ABSTRACT

A high-pressure discharge lamp with metal halide additives and a power input of less than 100W comprises electrodes (4, 5) which have a shank portion (18) adjacent the seal and a second portion (19) which is formed as a coil and faces the discharge. Adjacent turns of the coil portion (19) do not contact one another. Shank (18) and coil (19) are preferably made of a single piece of wire. In the case of a double-ended arc tube (FIGS. 1 and 2) the axis of the coil portion (19) forms a substantially straight line with the shank portion (18). In the case of a single-ended arc tube (FIGS. 3 and 4) the axis of the coil portion includes an angle of 90° with the axis of the shank portion. In order to protect the electrode, and especially the shank portion from corrosion, the shank (18) of the electrode (4, 5) is surrounded by a conical filament (17) of refractory metal e.g. tungston whose turns are lying closely together. Due to the specific shape of the electrode (4, 5), quicker starting of the lamp is achieved, even when the lamp is still warm.

19 Claims, 4 Drawing Figures

HIGH-PRESSURE DISCHARGE LAMP WITH LOW POWER INPUT

The present invention relates to high-pressure discharge lamps having a power input of less than 100 W whose arc tube, preferably quartz glass, contains a filling of mercury, additives of metal halides and rare gas as well as two electrodes of refractory metal hermetically sealed therein.

BACKGROUND

The development of high-pressure discharge lamps with metal halide fillings, has gone increasingly towards lamps with a low power input, more particularly lamps with a power input of less than 100 W. A great problem with this type of lamp is fast and reliable starting of a cold lamp, as well as restarting of the hot lamp, while maintaining a life of satisfactory length. Slow and difficult starting, which is due to unstable emanation of the arc from the electrodes, causes rapid blackening of the arc tube. The metal halides in the filling corrode the electrodes, especially in lamps of low power input in which the electrode shank has very small dimensions. Both the blackening of the arc tube and the corrosion of the electrodes result in the premature failure of the lamp.

Unstable arcing from the electrodes, i.e. power to transfer between electrode and the arc is caused primarily by the slow heating of the electrodes of this type generally have substantial heat loss. The German Patent Disclosure Document DE-OS No. 29 51 967 (to which British Pat. No. 2 043 331 corresponds) solves this problem for a double-ended miniature type metal halide discharge lamp by providing a self-heating electrode. The electrode comprises a current lead shank with a metal cap. A coil, about which a tungsten wire has been wrapped, is clamped on the metal cap. The construction of this electrode is very complex and is therefore very difficult to use in a miniaturized high-pressure discharge lamp of low power input.

The corrosion of the electrodes which begins especially at the electrode shank may be prevented, for example, by placing a small ceramic tube over the shank. Frequently, however, this causes problems when the ceramic material is sealed to the arc tube. The British Patent Specification GB-PS No. 1 242 173 describes a double-ended metal halide discharge lamp of 400 W wherein the electrodes have the form of a densely wound coil and are arranged at a right angle to the axis of the arc tube. This results in the ends of the arc tube being heated better, and reduction of the condensation of the metal salts in these regions. Corrosion of the electrodes is thus largely prevented. Turning the electrodes through 90° in a double-ended arc tube—the axes of the electrode coils include a substantially right angle with the arc—causes, however, quicker sputtering of the electrode tip and is disadvantageous for high-pressure discharge lamps of low power input as will be shown below.

THE INVENTION

It is an object to provide a high-pressure metal halide discharge lamp with a power input of less than 100 W which may be started quickly either in the cold or in the warm state and wherein corrosion of the electrodes is largely prevented. The electrode should be of simple construction and its manufacture inexpensive.

Briefly, in accordance with the invention, each electrode comprises a first portion in form of a straight shank adjacent the lamp seal and a second portion formed as an undulating, or looped portion, preferably in form of a coil which faces the discharge and whose undulations or loops, or adjacent turns do not touch one another.

Fast starting of the lamp depends on the formation of the arc on the electrodes which in turn is determined by the time required for heating the electrodes to thermionic emission. The heating time t is proportional to the square of the radius r of the electrode shank and inversely proportional to the length L of the electrode and the current I of the lamp ($t \simeq (r^2/L)\cdot(1/I)$). With a given radius of the electrode and a given operating current of the lamp, a reduction of the heating time may be obtained by increasing the electrode length.

In accordance with the invention, the electrode length is increased to obtain the requisite thermal heat flow without altering the electrode spacing and thus the arc length or increasing the size of the lamp, so that the dimensions of the arc tube may thus be kept low. It is important that the length of the electrode wire substantially exceeds the length and width of the electrode structure. The electrode is a preferred form, is a coil in which the individual turns of the coil do not touch one another so that thermal shorting is excluded. The pitch of the coil portion may be very low in the case of miniature lamps which have a power input of e.g., less than 50 W because of the very small electrode dimensions.

The electrode composed of the shank and coil portions consists preferably of a single piece of wire. The manufacture of this electrode is very simple since it does not require any welding. It is also conceivable, however, to assemble an electrode from two pieces, a shaft portion and a coil portion.

Operating voltage tests have been conducted with double-ended high-pressure discharge lamps in accordance with the invention in which the axes of the coil portions included angles of from 0° to 90° with the shank portions of the electrodes which, in double ended lamps, extends in the direction of the discharge arc. It became evident that with angles of 45° and higher the electrode tips are sputtered off very quickly and the lamp operating voltage and the restarting voltage rise considerably. Electrode sputtering was lowest with such electrode shapes where the axis of the coil and the axis of the discharge arc and hence the axis of the shank formed a substantially straight line. Here, the rise in the operating voltage was only a few volts after 3000 hours of operation.

In the preferred embodiment, the shank of the electrodes merges into the coil portion by a bend whereby an angle of up to 10° may result between the axis of the coil and the shank. The manufacture of such an electrode is simple and costs little. It has been found that a small angle of at most 10° between the shank and the axis of the coil does not cause a measurable operating and life deterioration with respect to an angle of 0°.

For a single-ended, press-sealed embodiment of the high-pressure discharge lamp in accordance with the invention it has proved advantageous to bend the electrode so that the axis of the coil includes an angle of 90° with the shank. The axes of the coil portions of the two electrodes are in this case substantially in parallel with the discharge arc. In this position, the sputtering from the electrode tips is lowest.

The lamp has the advantage that fast establishment of the arc is obtained and that blackening of the arc tube is largely avoided.

The shank temperature of the electrode of the invention is lower than the shank temperature of a known pin electrode because of the longer path from the hot electrode tip to the shank. Substantial temperature-dependent electrode corrosion caused by the metal halides in the lamp, especially by tin halides, thus may occur. The corrosion is worst at the transition to the seal and at the first bend at the transition from shank to coil.

Thicker electrodes will resist corrosion sufficiently long with respect to the lamp life. The larger wire diameter of the electrode, however, may cause much greater heat dissipation so that establishment of the arc deteriorates.

In accordance with a feature of the invention, in order to prevent corrosion the shank portion of the electrode of the lamp can be surrounded by a wrapping of refractory metal, e.g. tungsten. This wrapping extends, preferably, over the first turn of the electrode coil and its other end is sealed into the arc tube. This protects the transition from the shank to the coil and the region where the shank is sealed in the arc tube.

A wrapping which has proved particularly suitable is a filament whose individual turns lie closely together. The filament offers a good protection against electrode corrosion. At the same time, the heat dissipated to the quartz glass is not detrimentally increased so that a reliable establishment of the arc on the electrode is obtained.

Preferably, the filament serving as the protective wrapping is wound in slightly conical spiral form; the end having the larger filament diameter faces the coil portion of the electrode. The wide end resulting from the conical shape may readily be slipped over the first turn of the coil portion. The narrow end of the protective filament is dimensioned to resiliently and firmly engage the shank portion of the electrode wire.

DRAWINGS

Figure 1:
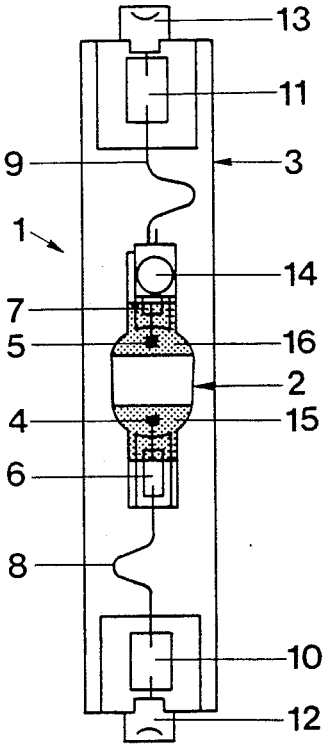
FIG. 1 shows the construction of a high-pressure discharge lamp in accordance with the invention having a double-ended arc tube.

The 70 W high-pressure discharge lamp 1 shown in FIG. 1 comprises a double-ended arc tube 2 of quartz glass enclosed in an outer envelope 3. The electrodes 4, 5, which are illustrated schematically, are hermetically sealed in the arc tube 2 by foils 6, 7 and connected via the leads 8, 9 to seal foils 10, 11 of the outer envelope 3 and by further short leads to the electrical terminals of the ceramic bases (of the R7s-type) 12, 13. A piece of wire is sealed—free of potential—in one end of the arc tube 2. The wire is provided with a small metal plate carrving getter material 14. The ends 15, 16 of the arc tube 2 are coated with a heatreflective coating. The arc tube 2 contains as a filling, in addition to mercury and a rare gas, metal iodides and metal bromides of at least one of sodium: tin; thallium; indium; lithium. The lamp 1 has a power input of 70 W, a rated current of 0.9 A and yields a light output of 4,900 lm (70 lm/W).

Figure 2:
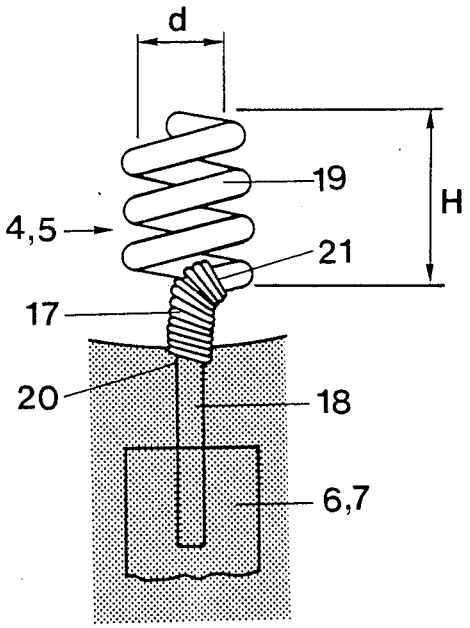
FIG. 2 shows an electrode for a high-pressure discharge lamp of FIG. 1.

FIG. 2 shows an electrode 4, 5 to an enlarged scale. The electrode has a surrounding protective filament 17. The electrode 4, 5 itself is made from a single piece of wire having a diameter of 0.4 mm. It has a shank 18 of 4.9 mm length and a coil 19 which has 3½ turns, with an overall height H of 2.7 mm height. The clear width between the individual turns of the coil portion 19—which has an internal diameter d of 1 mm—is 0.15 to 0.25 mm. The electrode 4, 5 is made of tungsten which has been enriched with 0.7% thorium dioxide and does not contain an emitter.

The protective filament 17 is made from a pure tungsten wire having a diameter of 0.1 mm. It has fourteen adjacent turns which form a spiral of 1.4 mm length. The protective filament 17 is wound in a spiral, with a conical, aperture angle of 2°. The one end 20 of the protective filament which has the smaller inner diameter of 0.35 mm. prior to assembly to the electrode wire adheres firmly to the shank 18 and is sealed with one turn into the arc tube 2. The other end 21 of the protective coil 17 which has the larger inner diameter covers the transition bend of the coil portion 19 of the electrode 4,5.

Figure 3:
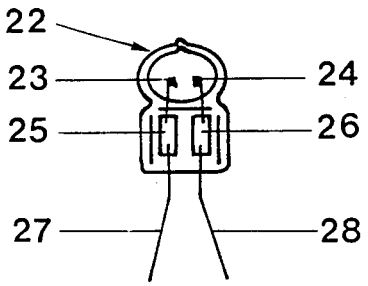
FIG. 3 shows the construction of a high-pressure discharge lamp having a single-ended arc tube.

FIG. 3 shows the construction of a single-ended arc tube 22 of quartz glass of a high-pressure discharge lamp in accordance with the invention having a power input of approximately 35 W. The electrodes 23, 24, which are illustrated schematically, are sealed in the arc tube 22 and connected via the seal foils 25, 26 to the leads 27, 28. The filling composition of the arc tube 22 is the same as that of the 70 W high-pressure discharge lamp 1 of FIG. 1.

Figure 4:
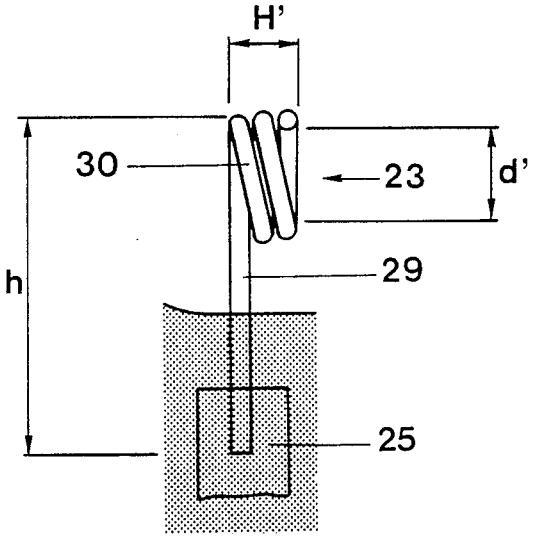
FIG. 4 shows an electrode for the high-pressure discharge lamp of FIG. 3.

FIG. 4 shows an electrode 23 of the single-ended arc tube 22 of FIG. 3. The electrode 23 has a height h of 8 mm and consists of a shank portion 29 and a coil portion 30 with 2¾ turns; the coil portion has a height $H^1$ of 0.9 mm. The clear width between the individual turns of the coil portion 30—which has an internal diameter $d^1$ of 0.3 mm—is 0.1 mm. The axis of the coil portion 30 is directed relative to the shank portion 29 at an angle of 90°. The electrode 23 also consists of tungsten enriched with 0.7% thorium dioxide and does not contain an emitter i.e. it is emitterless.

In the construction of FIG. 4, condensation on the end portions of the electrode is less of a problem because of the position of the electrodes in the envelopes. If the position of the electrodes can be so selected that condensation is reduced on the electrode—see FIG. 3—the wrapping 17 illustrated in FIG. 2 may not be necessary, although, of course, it can be used if required for extended lifetime of the lamp. Condensation may then take place on the bottom of the glass vessel of the arc tube, for example if the arc tube is burnt normally "base down" as shown in FIG. 3.

Various changes and modifications may be made within the scope of the inventive concept.

We claim:

1. A high-pressure discharge lamp having a power input of less than 100 W, comprising:

an arc tube (2, 22);

a filling, in said arc tube, including mercury, metal halides, and at least one rare gas;

two emitterless electrodes (4,5; 23,24) of refractory metal;

a seal means, hermetically sealing the electrodes in the arc tube; and means for facilitating starting of the lamp, including an electrode arrangement wherein each electrode (4,5; 23,24) is an elongated electrode element having a first, essentially straight, shank portion (18,29) located adjacent the seal means, and a second portion (19, 30), formed as a coil which extends from said shank portion and faces the discharge arc, and having adjacent coil turns which are configured to inhibit heat transfer between adjacent coil turns by being so placed that adjacent coil turns do not touch each other, said first (18, 29) and second (19, 30) portions comprising a single wire element.

2. Lamp according to claim 1 wherein the axis of the coil portion (19) forms a substantially straight line with the shank portion (18) of the electrode (4, 5).

3. Lamp according to claim 1 wherein the axis of the coil portion (30) includes an angle of about 90° with the axis of the shank portion (29) of the electrode (23, 24).

4. A lamp according to claim 1, further comprising means, for preventing corrosive attack on the shank portions of the filaments, including a wrapping of refractory material (17) surrounding and completely covering at least the shank portions (18) of the electrodes.

5. Lamp according to claim 4 wherein the end portion of the wrapping which faces the discharge extends at least into the first turn of the coil (19) of the electrode.

6. Lamp according to claim 4 wherein the end of the wrapping which faces away from the discharge is sealed into the seal means sealing the electrode into the arc tube.

7. Lamp according to claim 4 wherein said wrapping comprises a tightly wound filament (17) in which adjacent wrapping turns contact each other.

8. Lamp according to claim 7 wherein said wrapping forms a slightly conical spiral, with the end (21) having the greater diameter facing the coil portion (19) of the electrode (4, 5).

9. Lamp according to claim 2 further including a wrapping or refractory material (17) surrounding at least the shank portion (18) of the electrode (4, 5).

10. Lamp according to claim 9 wherein the end portion of the wrapping which faces the discharge extends at least into the first turn of the coil (19) of the electrode.

11. Lamp according to claim 9 wherein the end of the wrapping which faces away from the discharge is sealed into the seal means sealing the electrode into the arc tube.

12. Lamp according to claim 11 wherein the end portion of the wrapping which faces the discharge extends at least into the first turn of the coil (19) of the electrode.

13. Lamp according to claim 3 further including a wrapping or refractory material (17) surrounding at least the shank portion (18) of the electrode (4, 5).

14. Lamp according to claim 12 wherein the end portion of the wrapping which faces the discharge extends at least into the first turn of the coil (19) of the electrode; the end of the wrapping which faces away from the discharge is sealed into the seal means sealing the electrode into the arc tube.

15. Lamp according to claim 14 wherein said second portion of the electrode includes a region which is bent away, or angled from the axis of said shank portion;

and wherein the wrapping of refractory material extends at least in part over said angled-away region.

16. Lamp according to claim 14 wherein the end of the wrapping which faces away from the discharge is sealed into the seal means sealing the electrode into the arc tube.

17. Lamp according to claim 14 further including a wrapping of refractory material (17) surrounding at least the shank portion (18) of the electrode (4,5);

the end of the wrapping which faces away from the discharge is sealed into the seal means sealing the electrode into the arc tube.

18. Lamp according to claim 1 wherein the axes of the coils formed by the second portion of the filaments are in alignment and parallel to the direction of the discharge arc.

19. Lamp according to claim 1 wherein the axes of the coils formed by the second portion of the filaments are in alignment and in alignment with the direction of the discharge arc.

* * * * *